United States Patent [19]

Hensler et al.

[11] Patent Number: 4,934,175

[45] Date of Patent: Jun. 19, 1990

[54] TOOL FOR BENDING SHEET METAL AND METHOD THEREOF

[76] Inventors: Stan L. Hensler, 1180 Bayswater La., Cicero, Ind. 46034; Charles L. Hensler, 2217 S. Indiana, Kokomo, Ind. 46902

[21] Appl. No.: 352,724

[22] Filed: May 16, 1989

[51] Int. Cl.[5] ..... B21D 11/20

[52] U.S. Cl. ..... 72/458

[58] Field of Search ..... 72/457, 458, 459, 479, 72/319, 320, 321; 16/114 R; 81/489; 140/106

[56] References Cited

U.S. PATENT DOCUMENTS

| | | | |
|---|---|---|---|
| 1,744,413 | 1/1930 | Peterson et al. | 16/114 R |
| 1,909,284 | 5/1933 | Kuhn | 72/458 |
| 2,222,081 | 11/1940 | Leigh | 72/458 |
| 2,857,792 | 10/1958 | McNish | 72/458 |
| 3,848,454 | 11/1974 | Hall | 72/457 |
| 4,191,043 | 3/1980 | Schaffer | 72/458 |
| 4,315,422 | 2/1982 | McBride | 72/458 |

*Primary Examiner*—David Jones

*Attorney, Agent, or Firm*—Woodard, Emhardt, Naughton, Moriarty & McNett

[57] ABSTRACT

A tool and method for bending sheet metal. A pair of right angle members are spaced apart, but welded together forming a slot through which sheet metal may be extended. A removable rod configured tool is inserted through one of the members for application of leverage force to the tool about its longitudinal axis forming a bend in the sheet metal extending through the slot.

12 Claims, 3 Drawing Sheets

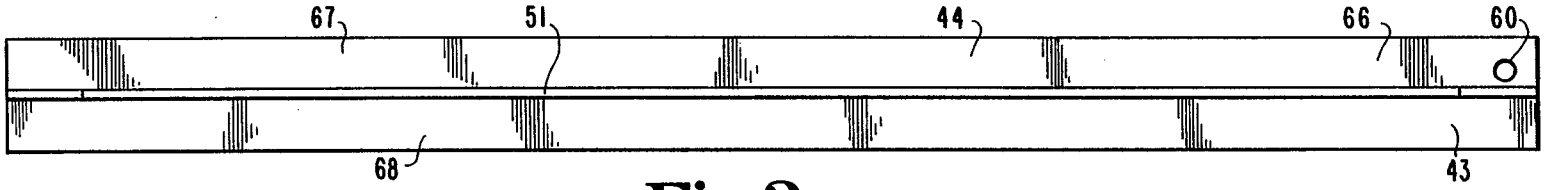
Fig.3
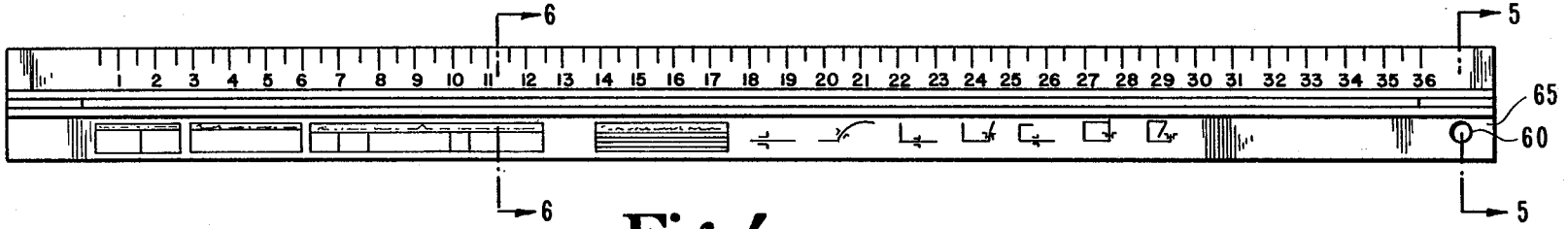
Fig.4
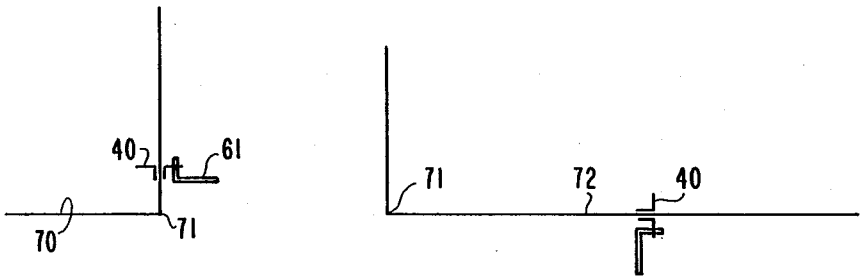
Fig.8
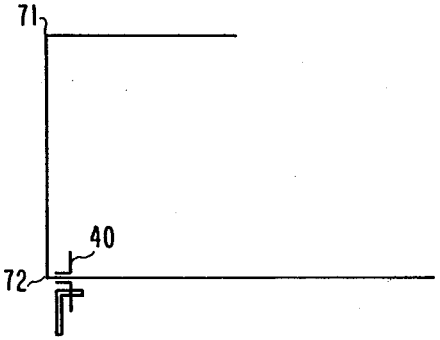
Fig.9
Fig.7

TOOL FOR BENDING SHEET METAL AND METHOD THEREOF

BACKGROUND OF THE INVENTION

Field of the Invention

This invention is in the field of tools used to bend and form sheet metal.

Airflow conduits used in conjunction with furnaces and air conditioning systems are in many cases formed at the building construction site. Construction personnel must therefore bend sheet metal shipped to the construction site in a flat state in order to configure the various conduits as required by the particular heating and cooling system. One of the co-inventors hereto devised a prior art sheet bending tool as shown in FIG. 1 to facilitate the bending and shaping of the flat sheet metal into the conduit configuration.

The prior art tool 20 includes a pair of right angle irons or members 21 and 22 having co-planar base walls 23 and 24 integrally joined to a pair of upstanding and parallel walls 25 and 26. A pair of spacers 27 and 28 are positioned between walls 25 and 26, respectively, at the opposite ends 30. Spacers 27 and 28 are secured to the inwardly mutually facing surfaces of walls 25 and 26 by welding or other suitable means. A slot 31 extends through tool 20 between walls 25 and 26, and between the inwardly facing edges of spacers 27 and 28. Likewise, slot 31 extends downwardly between base walls 23 and 24 allowing the flat sheet metal to be extended into the slot with the tool then being rotated about its longitudinal axis 32 to form a bend in the sheet metal.

Heretofore, the worker bending the sheet metal would grasp one end of tool 20 and rotate the tool about axis 32. Due to the relatively large size or width of sheet metal extending through slot 31, the application of force to rotate tool 20 is very tiring to the worker, particularly when a large amount of sheet metal is required to be formed to the various conduit configurations.

We have therefore designed a modified sheet bending tool having a leverage means to assist in the application of rotary force to the tool. Further, we have provided measurement and instruction indicia on the tool to assist in the use of the tool.

SUMMARY OF THE INVENTION

One embodiment of the present invention is a sheet metal tool comprising an elongated device with a longitudinal axis and including a base wall with an outwardly facing bottom surface and an outwardly facing top surface, the device further including an upright wall extending perpendicularly from the top surface, the base having a slot formed therethrough allowing sheet metal to extend through the base wall against the upright wall, and, a lever extending outwardly from the device and allowing the device to be rotated about the axis when force is applied to the lever bending the sheet metal against the upright wall forming an angle in the sheet metal.

Another embodiment of the present invention is a method of bending sheet metal comprising the steps of providing an elongated device with a longitudinal axis and including a base wall with an outwardly facing bottom surface and an outwardly facing top surface, the device further including an upright wall extending perpendicularly from the top surface, the base having a slot formed therethrough allowing sheet metal to extend through the base wall against the upright wall, inserting sheet metal through the slot, mounting a lever to the device, and, applying force to the lever twisting the device about the axis and bending the sheet metal.

It is an object of the present invention to provide a new and improved tool for bending sheet metal.

Another object of the present invention is to provide a sheet metal bending tool having leverage means for the increase of bending force.

In addition, it is an object of the present invention to provide a new and improved method of bending sheet metal.

Related objects and advantages of the present invention will be apparent from the following description.

BRIEF DESCRIPTION OF THE DRAWINGS

FIG. 3 is a bottom view of the tool of FIG. 2 without lever 61 shown.

FIG. 4 is a top view of the tool of FIG. 2 without lever 61 shown.

FIG. 7 is a schematic representation of the positioning of the tool after the first angle is formed.

FIG. 8 is a schematic representation of the positioning of the sheet bending tool immediately prior to the formation of the second bend.

FIG. 9 is a schematic representation of the positioning of the sheet metal bending tool immediately after formation of the second bend.

DESCRIPTION OF THE PREFERRED EMBODIMENT

Figure 1:
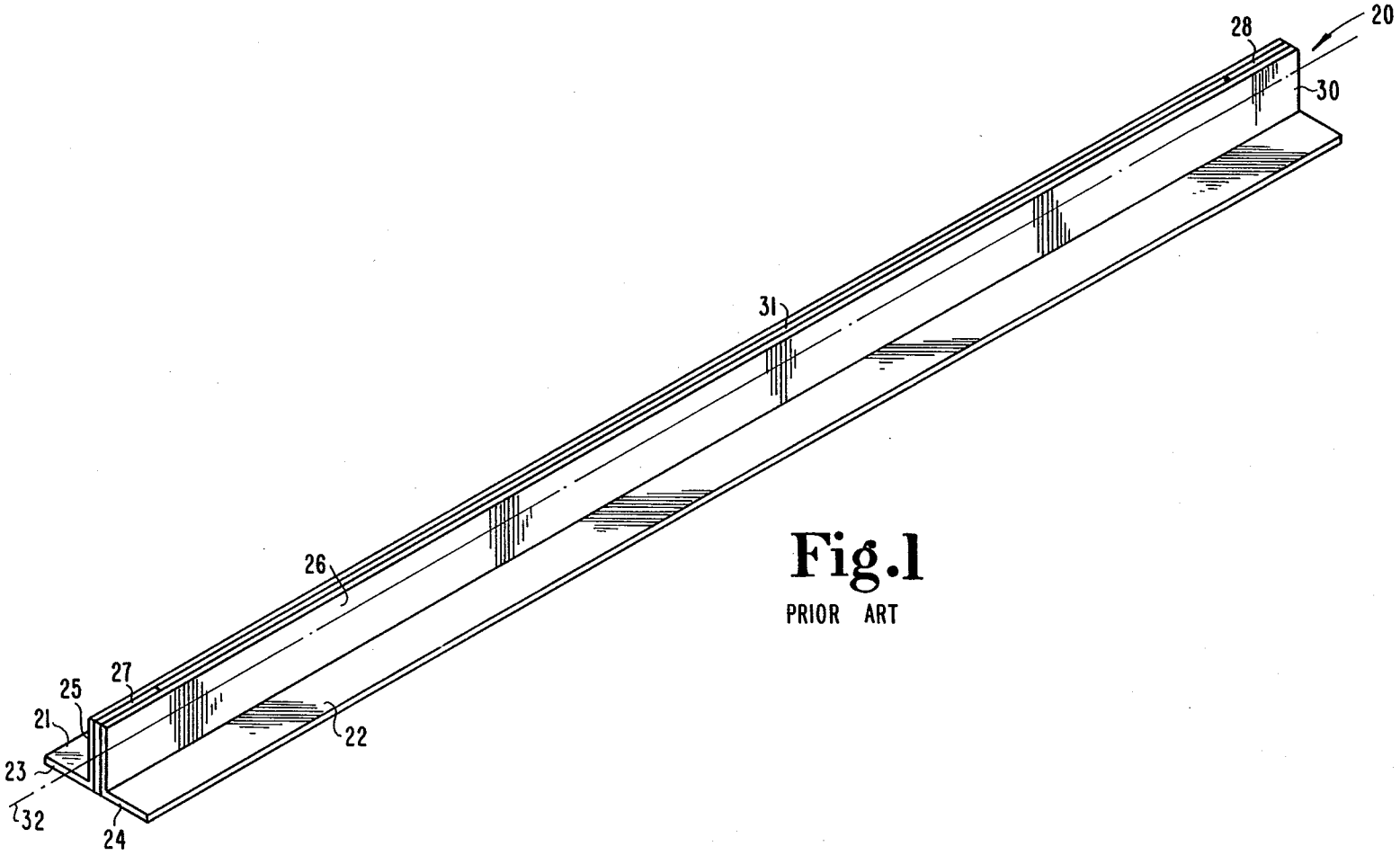
Fig.1 PRIOR ART
FIG. 1 is a perspective view of a prior art sheet metal bending tool.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally. occur to one skilled in the art to which the invention relates.

The improved sheet bending tool 40 is an elongated device having a pair of right angle members 41 and 42 attached together. Members 41 and 42 have co-planar base walls 43 and 44 integrally joined at right angles, respectively, to upstanding and parallel spaced apart walls 45 and 46. The upstanding walls extend in the same direction from the upwardly facing top surface of walls 43 and 44 and are spaced apart by spacers 47 and 48 positioned, respectively, at ends 49 and 50 of the tool. The spacers are rectangular plates which are fixedly fastened by welding or other suitable means to the inwardly facing surfaces of walls 45 and 46, thereby forming slot 51 which extends between the upstanding walls and between walls 43 and 44, as shown in FIG. 3. The inwardly facing edges 53 and 54 of spacers 47 and 48 form sheet metal stops at the opposite ends of slot 51 limiting movement of sheet metal which is extendable through the slot.

Leverage means consisting of hole 60 and right angle rod 61 allow the tool to be rotated about axis 52. Hole 60 extends through end 65 (FIG. 4) of base wall 44 of member 42. Hole 60 extends not only through the upwardly facing top surface 65, but also through the downwardly facing bottom surface 66 of base wall 44. Rod 61 consists of a relatively short rod portion 62 integrally joined at right angles to a relatively long rod portion 63. Rod portion 63 forms a handle to allow the construction worker to apply rotatable force to the tool thereby bending sheet metal extending through slot 51. Rod portions 62 and 63 are of the same diameter and have outside diameters smaller than the inside diameter of hole 60 allowing insertion of rod portion 62 into the hole. To facilitate ease of use, the handle portion 63 is also sized to pass freely through hole 60 to facilitate removal of rod 61 from wall 44. Hole 60 may also be placed in end portions 67 and/or 68 (FIG. 3) of the base walls.

Figures 2, 5, 6:
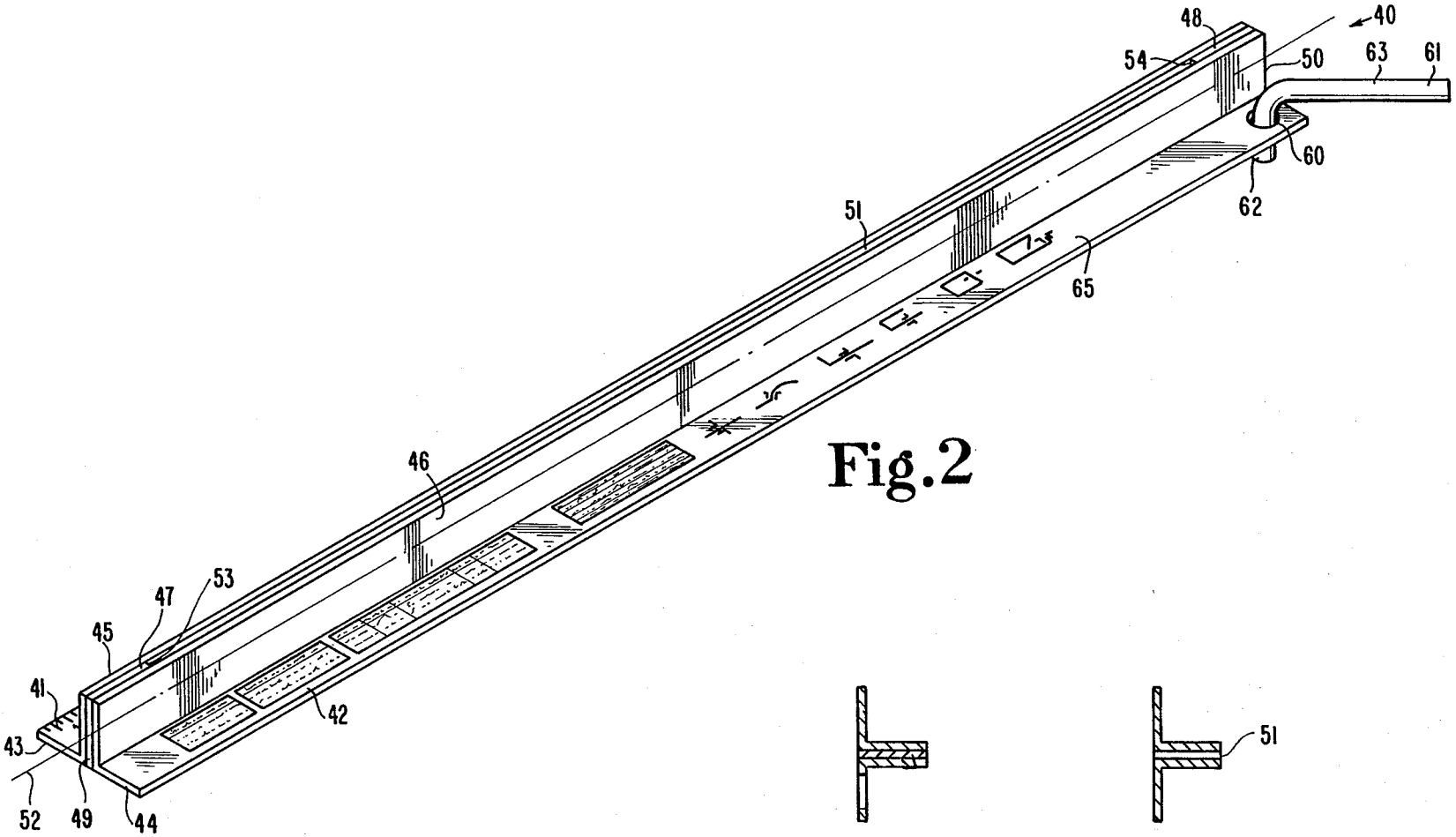
FIG. 2 is a perspective view of a sheet metal bending tool incorporating our new invention.
FIG. 5 is a cross-sectional view taken along the line 5—5 of FIG. 4 and viewed in the direction of the arrows.
FIG. 6 is a cross-sectional view taken along the line 6—6 of FIG. 4 and viewed in the direction of the arrows.

In the event it is desired to rotate tool 40 in a clockwise direction about axis 52 as viewed in FIG. 2, then rodlike portion 62 is inserted through the top surface 65 of wall 44 as shown in the drawing. On the other hand, if it is desired to rotate device 40 in a counter-clockwise direction about the axis as viewed in FIG. 2, then tool 61 is reversed by inserting rod portion 62 into hole 60 first through the bottom surface 66 of wall 44.

The method of bending sheet metal with tool 40 includes inserting sheet metal into slot 51 between upstanding walls 45 and 46 and then moving the sheet metal downwardly through the slot and between the spaced apart base walls 43 and 44. Lever 61 is then mounted to tool 40 and leverage force is applied to rotate the tool about the longitudinal axis. Thus, a first bend 71 (FIG. 7) in sheet metal 70 is formed by rotating device 40 by means of lever 61 in a counter-clockwise direction as viewed in the figure. To form a second bend, device 40 is moved apart from bend 71 to the location 72 (FIG. 8) of the second bend. Again, force is applied to lever 61 rotating device 40 in a counter-clockwise direction as viewed in FIG. 8 causing the second bend to occur at location 72 (FIG. 9). These steps are repeated until the final configuration of the conduit is achieved. The lever 61 is mounted to the tool by the step of inserting the lever through the base wall of one of the members. The lever may be moved to twist device 40 in either a clockwise direction or a counter-clockwise direction about the longitudinal axis to form either a left or right bend as necessitated by the configuration of the conduit. As previously described, the lever may be inserted initially either through the top surface 65 or bottom surface 66 into hole 60 depending upon the direction of rotation of device 40.

Measurement indicia forming a ruler is provided on the upwardly facing surface of wall 43 as shown on FIG. 4. Likewise, the upwardly facing surface of wall 44 includes charts providing the appropriate size of conduit required for specific air flow conditions, and further includes various instructional diagrams on proper use of the tool similar to the diagrams depicted in FIGS. 7–9 hereof.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A sheet metal tool comprising:

an elongated device with a longitudinal axis and including a base wall with an outwardly facing bottom surface and an outwardly facing top surface, said device further including an upright wall extending perpendicularly from said top surface, said base having a slot formed therethrough allowing sheet metal to extend through said base wall against said upright wall;

leverage means extending outwardly from said device and allowing said device to be rotated about said axis when force is applied to said leverage means bending said sheet metal against upright wall forming an angle in said sheet metal;

said leverage means to operable to be moved in a counterclockwise direction about said axis forcing said sheet metal against said upright wall forming a bend in said sheet metal and in a clockwise direction about said axis forcing said sheet metal against said upright wall forming a bend in said sheet metal, said slot also extends through said upright wall, said leverage means extends outwardly from said base wall, said leverage means includes a right angle rod removably mountable to said base; and, wherein said upright wall includes opposite ends forming sheet metal stops at opposite ends of said slot limiting movement of said sheet metal in said slot and said leverage means includes an aperture extending through said base wall at one end thereof.

2. The sheet metal tool of claim 1 wherein said device includes a pair of right angle members attached together, each of said members have a first wall and a second wall joined together at a right angle with said first wall of said members being coplanar with each other forming said base wall and said second wall of said members spaced apart but extending in the same direction from said base wall, said device further includes a pair of spacers positioned between and in contact with each second wall spacing said members apart and forming said upright wall and said slot in said base wall and said upright wall, said aperture is located in said first wall of one of said members.

3. The sheet metal tool of claim 2 wherein said first wall of one of said members forms a ruler and includes measurement indicia thereon whereas said first wall of the other of said members includes instruction indicia for proper use of the tool.

4. The sheet metal tool of claim 3 wherein said right angle rod is insertable from said top surface through said aperture.

5. The sheet metal tool of claim 3 wherein said right angle rod is insertable from said bottom surface through said aperture.

6. A sheet metal tool comprising:

a first right angle member with a first wall and a second wall extending perpendicularly therefrom, said first right angle member including a first end and an opposite second end;

a second right angle member with a third wall and a fourth wall extending perpendicularly therefrom said second right angle member including a third end and an opposite fourth end;

a first spacer positioned between and in contact with said second wall and said fourth wall at said first end and said third end;

a second spacer positioned between and in contact with said second wall and said fourth wall at said second end and said fourth end;

fastening means securing said first end of said first right angle member to said third end of said second right angle member and to said first spacer and further securing said second end of said first right angle member to said fourth end of said second right angle member and to said second spacer positioning said first wall coplanar with said third wall and said second wall aligned with but spaced apart from said fourth wall forming a slot extending between said first wall and said third wall and between said second wall and said fourth wall;

leverage means extending outwardly from said first right angle member and allowing said first right angle member and said second right angle member to be rotated together when force is applied to said leverage means bending said sheet metal extending through said slot forming an angle in said sheet metal; and, wherein said lever means extends outwardly from said first wall and includes a right angle rod removably mountable to said first wall, said leverage means also includes an aperture extending through said first at one end thereof, said first spacer and second spacer form sheet metal stops at opposite ends of said slot limiting movement of said sheet metal in said slot.

7. The sheet metal tool of claim 6 wherein said first wall forms a ruler and includes measurement indicia thereon whereas said third wall includes instruction indicia for proper use of the tool.

8. A method of bending sheet metal comprising the steps:

providing an elongated device with a longitudinal axis and including a base wall with an outwardly facing bottom surface and an outwardly facing top surface, said device further including an upright wall extending perpendicularly from said top surface, said base having a slot formed therethrough allowing sheet metal to extend through said base wall against said upright wall;

inserting sheet metal through said slot;

mounting a lever to said device;

inserting said lever through said base wall; and, applying force to said lever twisting said device about said axis and bending said sheet metal, sand wherein said applying step includes the substep of moving said lever to twist said device in either a clockwise direction about said axis or in a counter-clockwise direction about said axis forming a bend in said sheet metal.

9. The method of claim 8 and further comprising the step of;

inserting said lever from said top surface through said aperture.

10. The method of claim 8 and further comprising the step of:

inserting said lever from said bottom surface through said aperture.

11. A tool rotatable by a lever for bending sheet metal comprising:

a first right angle member with a first wall and a second wall extending perpendicularly therefrom, said first right angle member including a first end and an opposite second end;

a second right angle member with a third wall and a fourth wall extending perpendicularly therefrom, said second right angle member including a third end and an opposite fourth end;

a first spacer positioned between and in contact with said second wall and said fourth wall at said first end and said third end;

a second spacer positioned between and in contact with said second wall and said fourth wall at said second end and said fourth end;

fastening means securing said first end of said first right angle member to said third end of said second right member and to said first spacer and further securing said second end of said first right angle member to said fourth end of said second right angle member and to said second spacer positioning said first wall coplanar with said third wall and said second wall aligned with but spaced apart from said fourth wall forming a slot extending between said first wall and said third wall and between said second wall and said fourth wall; and, cooperative leverage means including an aperture extending through said first wall at one end thereof allowing said lever to be extended removably therethrough and extending outwardly from said first right angle member, with said first right angle member and said second right angle member being rotatable together when force is applied thereto bending said sheet metal extending through said slot forming an angle in said sheet metal; and, said first spacer and said second spacer forming sheet metal stops at opposite ends of said slot limiting movement of said sheet metal in said slot.

12. The tool of claim 11 wherein said first wall forms a ruler and includes measurement indicia thereon, whereas said third wall includes instruction indicia for proper use of said tool.

* * * * *

UNITED STATES PATENT AND TRADEMARK OFFICE

CERTIFICATE OF CORRECTION

PATENT NO. : 4,934,175

DATED : June 19, 1990

INVENTOR(S) : Stan L. Hensler et al.

It is certified that error appears in the above-identified patent and that said Letters Patent is hereby corrected as shown below:

In column 5, Line 29 please change "first at" to --first wall at--.
In column 5, Line 51 please change "sand" to --and--.
In column 6, Line 4 please change "of;" to --of:--.
In column 6, Line 29 please change "right member" to --right angle member--.

Signed and Sealed this

Twenty-fifth Day of June, 1991

*Attest:*

*Attesting Officer*

HARRY F. MANBECK, JR.

*Commissioner of Patents and Trademarks*